US010978014B2

(12) United States Patent
Yan

(10) Patent No.: US 10,978,014 B2
(45) Date of Patent: Apr. 13, 2021

(54) GAMMA VOLTAGE DIVIDER CIRCUIT, VOLTAGE ADJUSTING METHOD, AND LIQUID CRYSTAL DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventor: Weinan Yan, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 186 days.

(21) Appl. No.: 16/341,063

(22) PCT Filed: Jan. 17, 2019

(86) PCT No.: PCT/CN2019/072220
§ 371 (c)(1),
(2) Date: Apr. 11, 2019

(87) PCT Pub. No.: WO2020/118855
PCT Pub. Date: Jun. 18, 2020

(65) Prior Publication Data

US 2020/0234667 A1 Jul. 23, 2020

(30) Foreign Application Priority Data

Dec. 12, 2018 (CN) ..... 201811517430.5

(51) Int. Cl.
*G09G 3/36* (2006.01)
*G09G 3/3208* (2016.01)

(52) U.S. Cl.
CPC ..... *G09G 3/3648* (2013.01); *G09G 3/3208* (2013.01); *G09G 2320/0276* (2013.01); *G09G 2320/0673* (2013.01)

(58) Field of Classification Search
None
See application file for complete search history.

(56) References Cited

U.S. PATENT DOCUMENTS

2005/0259058 A1 11/2005 Yamaguchi et al.
2012/0206506 A1* 8/2012 Kim ..... G09G 3/20 345/690
2016/0049118 A1* 2/2016 Chen ..... G09G 3/3696 345/205

FOREIGN PATENT DOCUMENTS

CN 106409256 A 2/2017
CN 107369427 A 11/2017
(Continued)

*Primary Examiner* — Amare Mengistu
*Assistant Examiner* — Sarvesh J Nadkarni
(74) *Attorney, Agent, or Firm* — Mark M. Friedman

(57) ABSTRACT

A Gamma voltage divider circuit, a voltage adjusting method, and a liquid crystal display device are proposed. Compared to the arrangement of voltage dividing resistor string of the existing Gamma voltage divider circuit, by changing the mapping of band point voltages, the application can optimize accuracy of low gray-level voltages in a further step, improve the display effect, and at the same time, reduce the number of voltage dividing resistors and lower the complexity and cost of the Gamma voltage divider circuit. The Gamma voltage divider circuit is adaptable to the voltage dividing resistor string settings of OLED display panels as well as LCD panels.

11 Claims, 6 Drawing Sheets

(56) References Cited

FOREIGN PATENT DOCUMENTS

| | | | |
|---|---|---|---|
| CN | 107665689 | A | 2/2018 |
| JP | 2009008958 | A | 1/2009 |

* cited by examiner

GAMMA VOLTAGE DIVIDER CIRCUIT, VOLTAGE ADJUSTING METHOD, AND LIQUID CRYSTAL DISPLAY DEVICE

BACKGROUND

1. Field of the Disclosure

The present invention relates to display technologies, and more particularly to a Gamma voltage divider circuit, a voltage adjusting method, and a liquid crystal display device.

2. Description of the Related Art

With rapid development of Organic light emitting diode (OLED) display technologies in recent years, curved and flexible touch-controlled display products quickly enter the market and related technologies are also renewed rapidly. The OLED refers to a diode that consists of an organic semiconductor material and a luminous material and is caused to emit light by injection and recombination of carriers, driven by an electric field. OLED display devices have advantages such as high contrast, wide viewing angle, low power consumption, and thin and compact size. It is well considered as the most promising display devices in the industry. Active-matrix organic light emitting diodes (AMOLEDs) originates from the OLED display technologies. The AMOLED has a self-illumination function. Accordingly, AMOLED display panels are characterized by wide viewing angle, high color saturation. The AMOLED display panels are deemed as one of the most promising products because of low driving voltage and power consumption and features such as fast response, light weight, small thickness, simple structure, low cost, and etc.

FIG. 1 is a schematic diagram showing an existing OLED driving circuit. The OLED driving circuit includes a first thin-film transistor (TFT) T1, a second TFT T2, a capacitor Cst. The first TFT T1 is a switch TFT. The second TFT T2 is a driving TFT. The capacitor Cst is a storage capacitor. Specifically, the first TFT T1 has a source electrode electrically connected to a first node G, a gate electrode receiving a scan signal Scan, and a drain electrode receiving a data voltage Vdata. The second TFT T2 has a source electrode electrically connected to an anode of an organic light emitting diode DO, a drain electrode receiving a power source voltage OVDD, and a gate electrode electrically connected to the first node G A cathode of the organic light emitting diode DO receives a grounded common voltage OVSS. The capacitor Cst has an end electrically connected to the gate electrode of the second TFT T2 and another end receiving the power source voltage OVDD. When the OLED display panel displays images, the scan signal Scan controls T1 to turn on and the data voltage Vdata enters the gate electrode of T2 and the capacitor Cst via T1. Then, T1 is turned off but the data voltage is still kept at the gate electrode of T2 because of the capacitor Cst. As such, T2 is in a turned-on state. A driving electric circuit flows into the organic light emitting diode DO via T2 to drive the organic light emitting diode DO to emit light. The size of the data voltage Vdata can control brightness of the light emitted by the organic light emitting diode DO. Accordingly, a driving chip needs to produce an accurate data voltage Vdata to ensure that the OLED display panel displays images normally. Generally, the data voltage Vdata is produced by a Gamma voltage divider circuit of the driving chip.

FIG. 2 is a schematic diagram showing an existing Gamma voltage divider circuit. It usually needs to perform a gamma correction for a display apparatus to change display quality, according to sensitivity of human eyes to the light. The gamma correction is implemented by the Gamma voltage divider circuit of the driving chip. The Gamma voltage divider circuit needs a large amount of resistors for the voltage division to output appropriate voltages. As shown in FIG. 1, the existing Gamma voltage divider circuit consists of a plurality of voltage dividing resistors connected in series. The more the resistors, the higher the accuracy. In the present embodiment, a resistor string consists of 2048 voltage dividing resistors R0. For the OLED display panel, each gray-level value corresponds to a luminance value. A band point (BP) refers to several fixed gray levels, each of which has a corresponding gray-level voltage. Generally, after gray-level band point voltages corresponding to the band points are adjusted, the gray-level voltages in middle areas can be obtained by interpolation of the gray-level band point voltages VBPi. In the existing Gamma voltage divider circuit, each of the band points is sequentially adjusted to look for appropriate gray-level band point voltages VBPi for the voltage dividing resistors such that a curve of luminance vs. band point satisfies gamma relations, as shown in FIG. 3 which is an ideal curve of luminance vs. band point. As shown in FIG. 3, the resolution of the OLED display panel is represented by 8 digits, and thus 256 band point values BP0-BP255 and 256 luminance values L0-L255 corresponding thereto are included.

Generally, since the contrast ratio of the display panel depends on the highest luminance value L255 and the lowest luminance value L0, the lowest gray-level band point voltage VGSS and the highest gray-level band point voltage VGDD corresponding thereto are generally set as two independent voltages (i.e., the voltages at two ends of a voltage dividing resistor string). The voltage dividing resistor string is fixed in number. Accordingly, when the difference between the gray-level band point voltages VGDD/VGSS at the two ends of the resistor string increases, a voltage corresponding to each resistor also increases. As such, at the section of low gray levels, the brightness of the gray levels cannot be distinguished, as illustrated by a curve of band point vs. luminance shown in FIG. 4. It usually needs to perform a gamma correction for a display apparatus to change display quality, according to sensitivity of human eyes to the light. The gamma correction is implemented by the Gamma voltage divider circuit of the driving chip. This circuit needs a large amount of resistors for the voltage division to output appropriate voltages. However, accuracy of voltage division is not high enough. This results in indistinguishable gray levels. Alternatively, a large amount of resistors (e.g., 2048 resistors) are deployed in the resistor string. The resistor string consumes a large amount of resistors. This will increase complexity and cost of the Gamma voltage divider circuit.

SUMMARY

The objective of the present invention is to provide a Gamma voltage divider circuit, a voltage adjusting method, and a liquid crystal display device, which by inputting a gray-level threshold voltage to a middle between voltage dividing resistor strings, can optimize accuracy of low gray-level voltages and improve the display effect, and solve the problems of indistinguishable low gray levels caused by low accuracy of dividing voltages or increasing complexity and cost of the Gamma voltage divider circuit caused by consumption of a large amount of resistors by resistor strings.

To achieve above objective, the present invention provides a Gamma voltage divider circuit including: at least two gray-level resistor strings connected in series, each of the gray-level resistor strings including a plurality of voltage dividing resistors for providing a plurality of gray-level band point voltages, each of the gray-level band point voltages corresponding to a band point; and at least a gray-level threshold voltage, inputted to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings.

To achieve above objective, the present invention further provides a liquid crystal display device, including a Gamma voltage divider circuit which includes: at least two gray-level resistor strings connected in series, each of the gray-level resistor strings including a plurality of voltage dividing resistors for providing a plurality of gray-level band point voltages, each of the gray-level band point voltages corresponding to a band point; and at least a gray-level threshold voltage, inputted to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings.

To achieve above objective, the present invention further provides a voltage adjusting method, for adjusting a plurality of gray-level band point voltages provided by a Gamma voltage divider circuit of a liquid crystal display device, the method including: (1) determining a gray-level threshold voltage corresponding to at least a gray-level threshold band point; (2) based on all of the gray-level threshold band points, dividing the Gamma voltage divider circuit into a plurality of gray-level resistor strings connected in series, each of the gray-level resistor strings including a plurality of voltage dividing resistors for providing a plurality of gray-level band point voltages, each of the gray-level band point voltages corresponding to a band point; (3) providing the gray-level threshold voltage to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings; and (4) sequentially selecting band points of the Gamma voltage divider circuit, and adjusting the gray-level band point voltages of the selected band points until all of the band points of the Gamma voltage divider circuit are adjusted one by one.

The advantages of the present invention are described as follows. Compared to the arrangement of voltage dividing resistor string of the existing Gamma voltage divider circuit, by changing the mapping of band point voltages, the Gamma voltage divider circuit of the present invention can optimize accuracy of low gray-level voltages in a further step, improve the display effect, and at the same time, reduce the number of voltage dividing resistors and lower the complexity and cost of the Gamma voltage divider circuit. The voltage adjusting method of the present invention is adaptable to the voltage dividing resistor string settings of OLED display panels and is also adaptable to the voltage dividing resistor string settings of LCD panels.

BRIEF DESCRIPTION OF THE DRAWINGS

To illustrate the technical solutions in the embodiments of the present invention more clearly, the following briefly introduces the accompanying drawings required for describing the embodiments of the present invention. Apparently, the accompanying drawings in the following description show some embodiments of the present invention, and a person of ordinary skill in the art may still derive other drawings from these accompanying drawings without creative efforts.

DETAILED DESCRIPTION OF THE PREFERRED EMBODIMENTS

Figure 1:
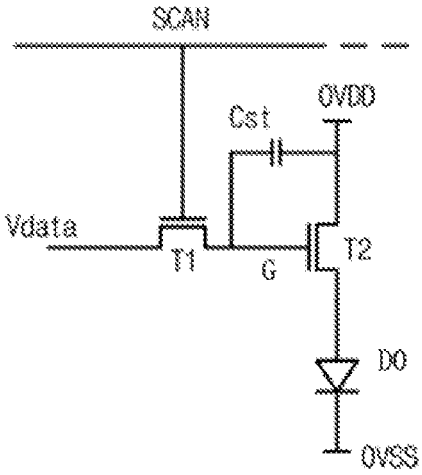
FIG. 1 (Prior Art)
FIG. 1 is a schematic diagram showing an existing OLED driving circuit.
Figure 2:
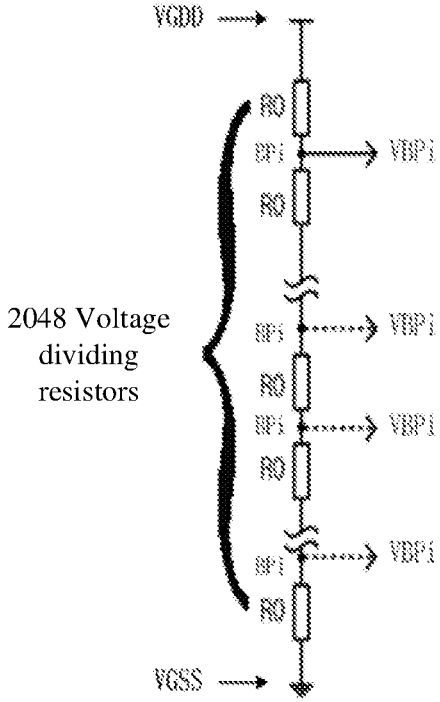
FIG. 2 (Prior Art)
FIG. 2 is a schematic diagram showing an existing Gamma voltage divider circuit.
Figure 3:
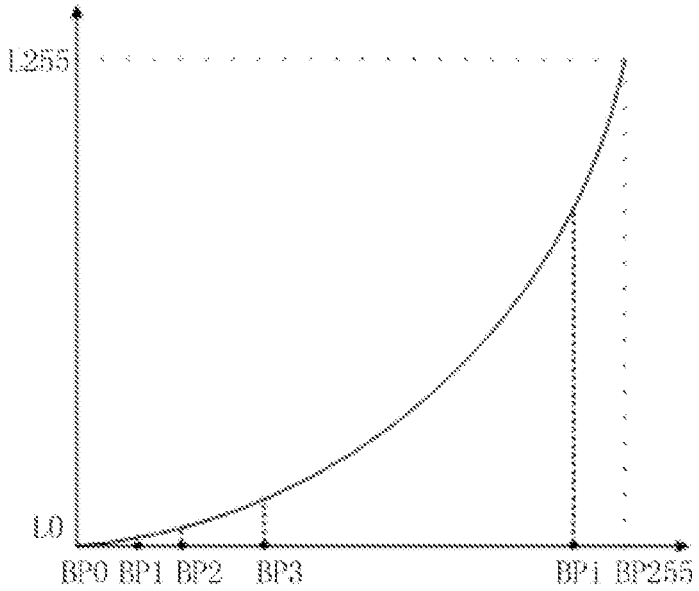
FIG. 3 (Prior Art)
FIG. 3 is a diagram showing an ideal curve of band point vs luminance.
Figure 4:
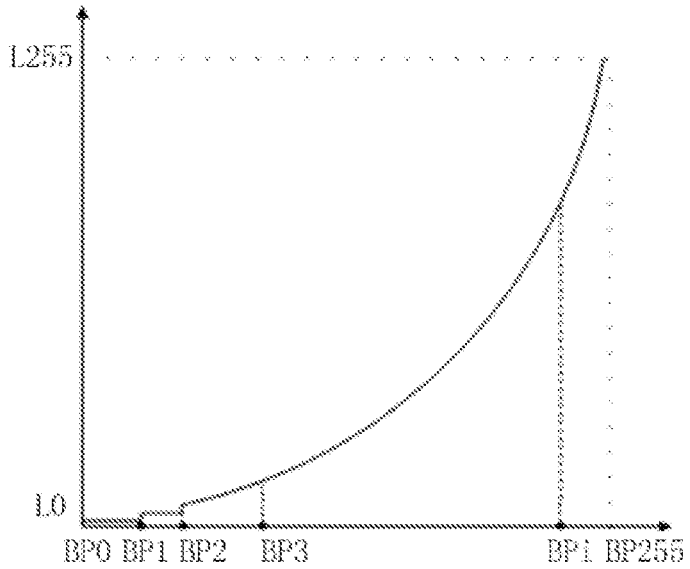
FIG. 4 (Prior Art)
FIG. 4 is a diagram showing a curve of band point vs luminance in an existing art.

The embodiments of the present invention will be described in detail below. The embodiments are illustrated in the appending drawings, in which the same or similar reference numbers are throughout referred to as the same or similar components or the components having the same or similar functions. The embodiments described below with reference to the appending drawings are exemplary and are merely used to illustrate the present invention, and should not be construed as limitations of the present invention.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above" or "on top of" a second feature may include an embodiment in which the first feature is right or obliquely "on," "above" or "on top of" the second feature, or just means that the first feature is at a height higher than that of the second feature; while a first feature "below," "under" or "on bottom of" a second feature may include an embodiment in which the first feature is right or obliquely "below," "under" or "on bottom of" the second feature, or just means that the first feature is at a height lower than that of the second feature.

The following disclosure provides many different embodiments or examples to implement different structures of the present invention. In order to simplify the present invention, the components and arrangements of specific examples are described in the following. Apparently, they are just exemplary, and do not intend to limit the present invention. In addition, reference numbers and/or letters can be repeated in different examples of the present invention for the purposes of simplification and clearness, without indicating the relationships between the discussed embodiments and/or arrangements. Further, the present invention provides examples of various specific processes and materials, but an ordinary person in the art can realize the availability of other processes and/or usage of other materials.

A Gamma voltage divider circuit provided in the present invention includes: at least two gray-level resistor strings connected in series, each of the gray-level resistor strings including a plurality of voltage dividing resistors for providing a plurality of gray-level band point voltages, each of the gray-level band point voltages corresponding to a band point; and at least a gray-level threshold voltage, inputted to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings.

A gray-level threshold band point (BPth) corresponding to the gray-level threshold voltage (VGth) of the Gamma voltage divider circuit of the present invention can be used to distinguish between large-span middle, high gray levels and low gray levels difficult to distinguish differences between corresponding voltages. According to a display effect of a display apparatus, two gray-level resistor strings for middle and high gray levels and low gray levels may be designed with an inputted gray-level threshold voltage. Also, according to the display effect of the display apparatus, three gray-level resistor strings for high, middle, and low gray levels may be designed with two or more inputted gray-level threshold voltages. Before low gray-level band point voltages are set, it has to determine a gray-level threshold voltage corresponding to the gray-level threshold band point. Then, the gray-level band point voltage is inputted to a common terminal of two adjacent voltage dividing resistor strings. At low gray levels, it needs to have enough voltage dividing resistors to have sufficient fine gray-level voltages such that displayed gray levels are all distinguishable. Compared to the arrangement of voltage dividing resistor string of the existing Gamma voltage divider circuit, by changing the mapping of band point voltages, the Gamma voltage divider circuit of the present invention can optimize accuracy of low gray-level voltages in a further step, improve the display effect, and at the same time, reduce the number of voltage dividing resistors and lower the complexity and cost of the Gamma voltage divider circuit. The Gamma voltage divider circuit of the present invention is adaptable to the voltage dividing resistor string settings of OLED display panels and is also adaptable to the voltage dividing resistor string settings of LCD panels.

Figure 5:
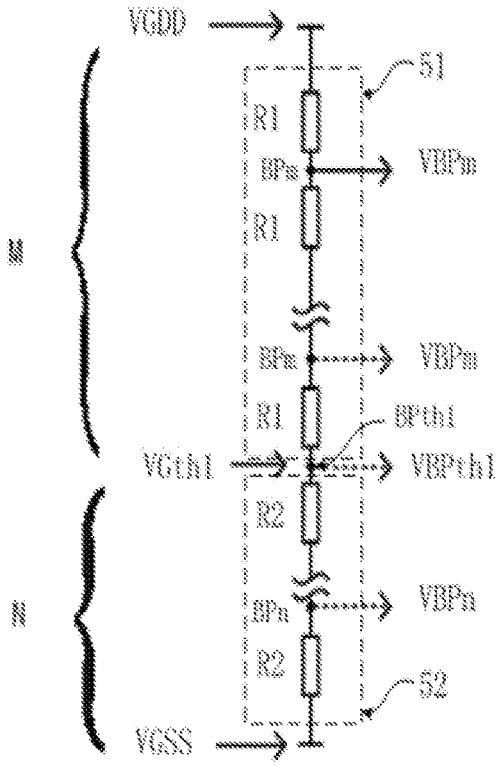
FIG. 5 is a schematic diagram showing a Gamma voltage divider circuit according to a first embodiment of the present invention.

FIG. 5 is a schematic diagram showing a Gamma voltage divider circuit according to a first embodiment of the present invention. In the present embodiment, the Gamma voltage divider circuit includes a first gray-level resistor string 51, a second gray-level resistor string 52, and a first gray-level threshold voltage VGth1.

The first gray-level resistor string 51 includes M first voltage dividing resistors R1. The first gray-level resistor string 51 provides M first gray-level band point voltages VBPm. Each of the first gray-level band point voltages VBPm corresponds to a first band point BPm.

The second gray-level resistor string 52 is connected in series with the first gray-level resistor string 51. The second gray-level resistor string 52 includes N second voltage dividing resistors R2. The second gray-level resistor string 52 provides N second gray-level band point voltages VBPn. Each of the second gray-level band point voltages VBPn corresponds to a second band point BPn.

The first gray-level threshold voltage VGth1 is inputted to a common terminal (i e, a first gray-level threshold band point BPth1) of the second gray-level resistor string 52 and the first gray-level resistor string 51. The first gray-level threshold voltage VGth1 is greater than all of the second gray-level band point voltages VBPn and is smaller than all of the first gray-level band point voltages VBPm. The top end of the first gray-level resistor string 51 corresponds to a highest gray-level band point voltage VGDD. Correspondingly, the bottom end of the second gray-level resistor string 52 corresponds to a lowest gray-level band point voltage VGSS. VGDD and VGSS are set as two independent voltages.

Specifically, all of band points in the Gamma voltage divider circuit are divided into M first band points BPm and N second band points BPn based on a first gray-level threshold band point BPth1. The M first voltage dividing resistors R1 corresponding to the M first band points BPm are adopted as the first gray-level resistor string 51. The N second voltage dividing resistors R2 corresponding to the N second band points BPn are adopted as the second gray-level resistor string 52. A gray-level voltage corresponding to the first gray-level threshold band point BPth1 is the first gray-level threshold voltage VGth1.

In the present embodiment, the first gray-level threshold band point BPth1 is used to distinguish between large-span middle and high gray levels and low gray levels difficult to distinguish differences between corresponding voltages. The first gray-level threshold voltage VGth1 is required to input to a middle between band points of the middle and high gray levels and band points of the low gray levels. That is, before low gray-level band point voltages are set, it has to determine a gray-level threshold voltage corresponding to the gray-level threshold band point. Then, the gray-level band point voltage is inputted to a common terminal of two adjacent voltage dividing resistor strings. At the low gray levels, a sufficient amount of voltage dividing resistors are provided to have sufficient fine gray-level voltages such that displayed gray levels are all distinguishable.

In the present embodiment, at the section of middle and high gray levels (i.e., the first gray-level resistor string 51), the voltage of each of the voltage dividing resistors is:

$$VR1=(VGDD-VGth1)/M,$$

where VGDD is the highest gray-level threshold voltage, VGth1 is the first gray-level threshold voltage, and M is the number of the voltage dividing resistors R1 of the first gray-level resistor string 51.

In the present embodiment, at the section of low gray levels (i.e., the second gray-level resistor string 52), the voltage of each of the voltage dividing resistors is:

$$VR2=(VGth1-VGSS)/N,$$

where VGth1 is the first gray-level threshold voltage, VGSS is the lowest gray-level band point voltage, and N is the number of the voltage dividing resistors R2 of the second gray-level resistor string 52.

Figure 6:
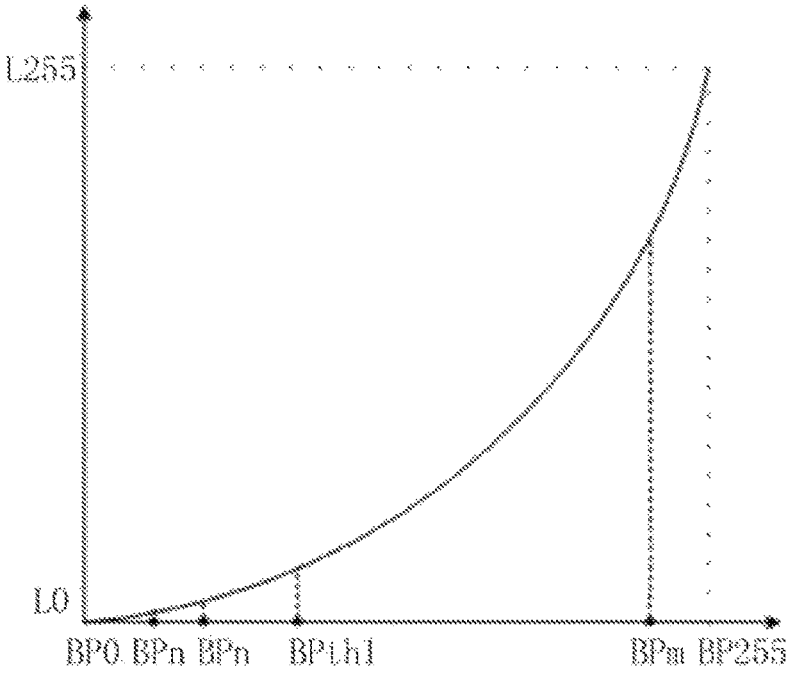
FIG. 6 is a diagram showing a curve of band point vs luminance according to the present invention.

In the Gamma voltage divider circuit of the present invention, the gray-level band point voltage corresponding to the gray-level threshold band point is determined before low gray-level band point voltages are set. The gray-level band point voltage is inputted to a common terminal of two adjacent voltage dividing resistor strings. Then, each of the band points BPm, BPn is sequentially adjusted to look for appropriate gray-level band point voltages for the voltage dividing resistors such that a curve of luminance vs. band point satisfies gamma relations, as shown in FIG. 6 which is the curve of luminance vs. band point of the present invention. As shown in FIG. 6, the resolution of an OLED display panel is represented by 8 digits, and thus 256 band point values BP0-BP255 and 256 luminance values L0-L255 corresponding thereto are included.

Figure 7:
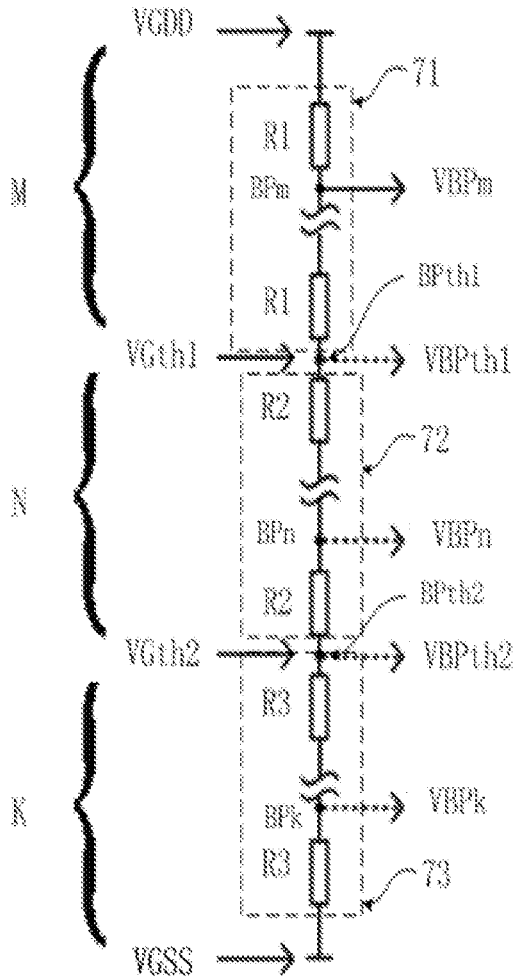
FIG. 7 is a schematic diagram showing a Gamma voltage divider circuit according to a second embodiment of the present invention.

FIG. 7 is a schematic diagram showing a Gamma voltage divider circuit according to a second embodiment of the present invention. In the present embodiment, the Gamma voltage divider circuit includes a first gray-level resistor string 71, a second gray-level resistor string 72, a third gray-level resistor string 73, a first gray-level threshold voltage VGth1, and a second gray-level threshold voltage VGth2.

The first gray-level resistor string 71 includes M first voltage dividing resistors R1. The first gray-level resistor string 71 provides M first gray-level band point voltages VBPm. Each of the first gray-level band point voltages VBPm corresponds to a first band point BPm.

The second gray-level resistor string 72 is connected in series with the first gray-level resistor string 71. The second gray-level resistor string 72 includes N second voltage dividing resistors R2. The second gray-level resistor string 72 provides N second gray-level band point voltages VBPn. Each of the second gray-level band point voltages VBPn corresponds to a second band point BPn.

The third gray-level resistor string 73 is connected in series with the second gray-level resistor string 72. The third gray-level resistor string 73 includes K third voltage dividing resistors R3. The third gray-level resistor string 73 provides N third gray-level band point voltages VBPk. Each of the third gray-level band point voltages VBPk corresponds to a third band point BPk.

The first gray-level threshold voltage VGth1 is inputted to a common terminal (i e, a first gray-level threshold band point BPth1) of the second gray-level resistor string 72 and the first gray-level resistor string 71. The first gray-level threshold voltage VGth1 is greater than all of the second gray-level band point voltages VBPn and is smaller than all of the first gray-level band point voltages VBPm.

The second gray-level threshold voltage VGth2 is inputted to a common terminal (i.e., a second gray-level threshold band point BPth2) of the third gray-level resistor string 73 and the second gray-level resistor string 72. The second gray-level threshold voltage VGth2 is greater than all of the third gray-level band point voltages VBPk and is smaller than all of the second gray-level band point voltages VBPn.

The top end of the first gray-level resistor string 71 corresponds to a highest gray-level band point voltage VGDD. Correspondingly, the bottom end of the third gray-level resistor string 73 corresponds to a lowest gray-level band point voltage VGSS. VGDD and VGSS are set as two independent voltages.

Specifically, all of band points in the Gamma voltage divider circuit are divided into M first band points BPm, N second band points BPn, and K third band points BPk based on a first gray-level threshold band point BPth1 and a second gray-level threshold band point BPth2. M first voltage dividing resistors R1 corresponding to the M first band points are adopted as the first gray-level resistor string 71. N second voltage dividing resistors R2 corresponding to the N second band points BPn are adopted as the second gray-level resistor string 72. K third voltage dividing resistors R3 corresponding to the K third band points BPk are adopted as the third gray-level resistor string 73. A gray-level voltage corresponding to the first gray-level threshold band point BPth1 is the first gray-level threshold voltage VGth1 and a gray-level voltage corresponding to the second gray-level threshold band point BPth2 is the second gray-level threshold voltage VGth2.

In the present embodiment, the first gray-level threshold band point BPth1 is used to distinguish between large-span middle and high gray levels. The first gray-level threshold voltage VGth1 is required to input to a middle between high gray-level band points and middle gray-level band points. The second gray-level threshold band point BPth2 is used to distinguish between large-span middle gray levels and low gray levels difficult to distinguish differences between corresponding voltages. The second gray-level threshold voltage VGth2 is required to input to a middle between band points of middle gray-level band points and low gray-level band points. Similarly, before low gray-level band point voltages are set, it has to determine gray-level threshold voltages corresponding to two gray-level threshold band points. Then, each of the two gray-level band point voltages is inputted to a common terminal of two adjacent voltage dividing resistor strings. At the low gray levels, a sufficient amount of voltage dividing resistors are provided to have sufficient fine gray-level voltages such that displayed gray levels are all distinguishable.

In the present embodiment, at the section of high gray levels (i.e., the first gray-level resistor string 71), the voltage of each of the voltage dividing resistors is:

$$VR1=(VGDD-VGth1)/M,$$

where VGDD is the highest gray-level threshold voltage, VGth1 is the first gray-level threshold voltage, and M is the number of the voltage dividing resistors R1 of the first gray-level resistor string 51.

In the present embodiment, at the section of middle gray levels (i.e., the second gray-level resistor string 72), the voltage of each of the voltage dividing resistors is:

$$VR2=(VGth1-VGth2)/N,$$

where VGth1 is the first gray-level threshold voltage, VGth2 is the first gray-level threshold voltage, and N is the number of the voltage dividing resistors R2 of the second gray-level resistor string 72.

In the present embodiment, at the section of low gray levels (i.e., the second gray-level resistor string 73), the voltage of each of the voltage dividing resistors is:

$$VR3=(VGth2-VGSS)/K,$$

where VGth2 is the second gray-level threshold voltage, VGSS is the lowest gray-level band point voltage, and K is the number of the voltage dividing resistors R3 of the third gray-level resistor string 73.

In the Gamma voltage divider circuit of the present invention, the gray-level band point voltages corresponding to two gray-level threshold band points are determined before low gray-level band point voltages are set. Each of the two gray-level band point voltages is inputted to a common terminal of two adjacent voltage dividing resistor strings. Then, each of the band points BPm, BPn, BPk is sequentially adjusted to look for appropriate gray-level band point voltages for the voltage dividing resistors such that a curve of luminance vs. band point satisfies gamma relations, referring to FIG. 6 which is the curve of luminance vs. band point of the present invention.

The present invention further provides a liquid crystal display device which adopts the Gamma voltage divider circuit of any of the afore-mentioned embodiments of the present invention. The Gamma voltage divider circuit generates data voltages Vdata to ensure a display panel of the liquid crystal display device displays images normally. The display panel can be implemented by an OLED display panel and can also be implemented by a LCD panel.

Figure 8:
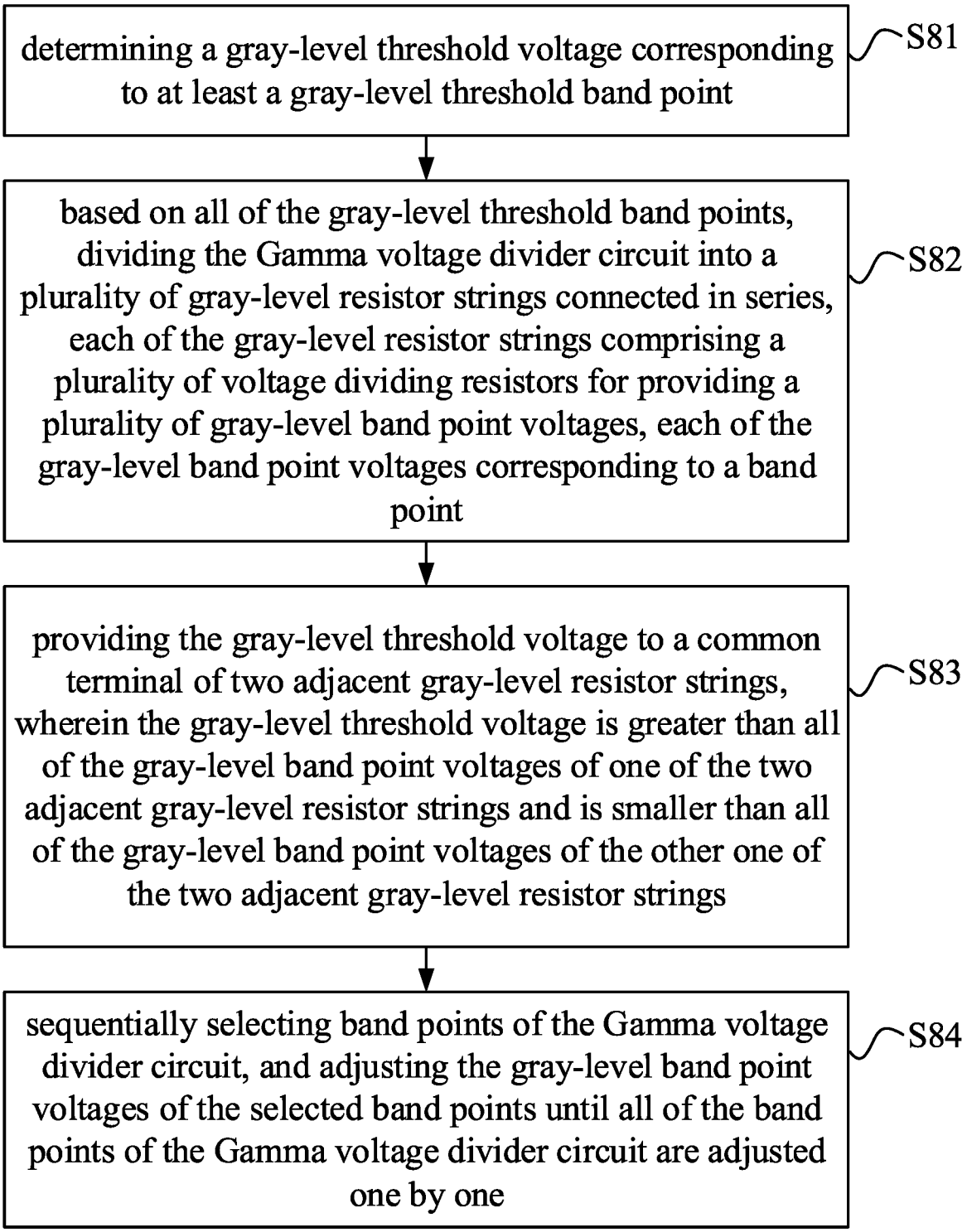
FIG. 8 is a framework of a voltage adjusting method according to an embodiment of the present invention.

The present invention further provides a voltage adjusting method for adjusting a plurality of gray-level band point voltages provided by a Gamma voltage divider circuit of a liquid crystal display device. FIG. 8 is a framework of a voltage adjusting method according to an embodiment of the present invention. The voltage adjusting method includes steps of (S81) determining a gray-level threshold voltage corresponding to at least a gray-level threshold band point; (S82) based on all of the gray-level threshold band points, dividing the Gamma voltage divider circuit into a plurality of gray-level resistor strings connected in series, each of the gray-level resistor strings including a plurality of voltage dividing resistors for providing a plurality of gray-level band point voltages, each of the gray-level band point voltages corresponding to a band point; (S83) providing the gray-level threshold voltage to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings; and (S84) sequentially selecting band points of the Gamma voltage divider circuit, and adjusting the gray-level band point voltages of the selected band points until all of the band points of the Gamma voltage divider circuit are adjusted one by one.

Optionally, according to a display effect of a display apparatus, two gray-level resistor strings for middle and high gray levels and low gray levels may be designed with an inputted gray-level threshold voltage in the voltage adjusting method of the present invention. Before low gray-level band point voltages are set, it has to determine a gray-level threshold voltage corresponding to the gray-level threshold band point. Then, the gray-level band point voltage is inputted to a common terminal of two adjacent voltage dividing resistor strings. At the low gray levels, a sufficient amount of voltage dividing resistors are provided to have sufficient fine gray-level voltages such that displayed gray levels are all distinguishable. Specifically, Step S81 further includes determining a first gray-level threshold voltage corresponding to a first gray-level threshold band point; Step S82 further includes dividing all of the band points in the Gamma voltage divider circuit into a plurality of first band points and a plurality of second band points based on the first gray-level threshold band point, adopting a plurality of first voltage dividing resistors corresponding to the plurality of first band points as a first gray-level resistor string, and adopting a plurality of second voltage dividing resistors corresponding to the plurality of second band points as a second gray-level resistor string; and Step S83 further includes providing the first gray-level threshold voltage to a common terminal of the first gray-level resistor string and the second gray-level resistor string, wherein the first gray-level threshold voltage is greater than all of the gray-level band point voltages of the second gray-level resistor string and is smaller than all of the gray-level band point voltages of the first gray-level resistor string.

Optionally, according to a display effect of a display apparatus, three gray-level resistor strings for high, middle, and low gray levels may be designed with two or more inputted gray-level threshold voltages in the voltage adjusting method of the present invention. Before low gray-level band point voltages are set, it has to determine gray-level threshold voltages corresponding to two gray-level threshold band points. Then, each of the two gray-level band point voltages is inputted to a common terminal of two adjacent voltage dividing resistor strings. At the low gray levels, a sufficient amount of voltage dividing resistors are provided to have sufficient fine gray-level voltages such that displayed gray levels are all distinguishable. Specifically, Step S81 further includes determining a first gray-level threshold voltage corresponding to a first gray-level threshold band point and determining a second gray-level threshold voltage corresponding to a second gray-level threshold band point; Step S82 further includes dividing all of the band points in the Gamma voltage divider circuit into a plurality of first band points, a plurality of second band points, and a plurality of third band points based on the first gray-level threshold band point and the second gray-level threshold band point, adopting a plurality of first voltage dividing resistors corresponding to the plurality of first band points as a first gray-level resistor string, adopting a plurality of second voltage dividing resistors corresponding to the plurality of second band points as a second gray-level resistor string, and adopting a plurality of third voltage dividing resistors corresponding to the plurality of third band points as a third gray-level resistor string; and Step S83 further includes providing the first gray-level threshold voltage to a common terminal of the first gray-level resistor string and the second gray-level resistor string and providing the second gray-level threshold voltage to a common terminal of the second gray-level resistor string and the third gray-level resistor string, wherein the first gray-level threshold voltage is greater than all of the gray-level band point voltages of the second gray-level resistor string and is smaller than all of the gray-level band point voltages of the first gray-level resistor string, and the second gray-level threshold voltage is greater than all of the third gray-level band point voltages and is smaller than all of the second gray-level band point voltages.

Specifically, the step of sequentially selecting band points of the Gamma voltage divider circuit, and adjusting the gray-level band point voltages of the selected band points until all of the band points of the Gamma voltage divider circuit are adjusted one by one can be 1) sequentially selecting the band points of the Gamma voltage divider circuit according to an order of band point labels from low to high; 2) determining the gray-level band point voltage of a selected band point; 3) determining whether the determined gray-level band point voltage is equal to a predetermined target voltage, and executing Step 4) if yes and changing a voltage dividing location and returning back to Step 2) if no; and 4) determining whether the band point label of the selected band point is smaller than a highest band point label, and terminating an adjustment of the band point if yes and updating the band point label and returning back to Step 1) if no. In order to make sure that each of the band points can be adjusted sequentially, Step 3) will determine whether the band points are selected one by one. When the band points are not selected one by one, a voltage dividing location is changed and the process returns back to Step 2) for selecting the remainder of the band points for the adjustment. Correspondingly, when the band points have been selected one by one, it means that the band points have been adjusted one by one. Accordingly, the adjustment for these band points is terminated.

Figure 9:
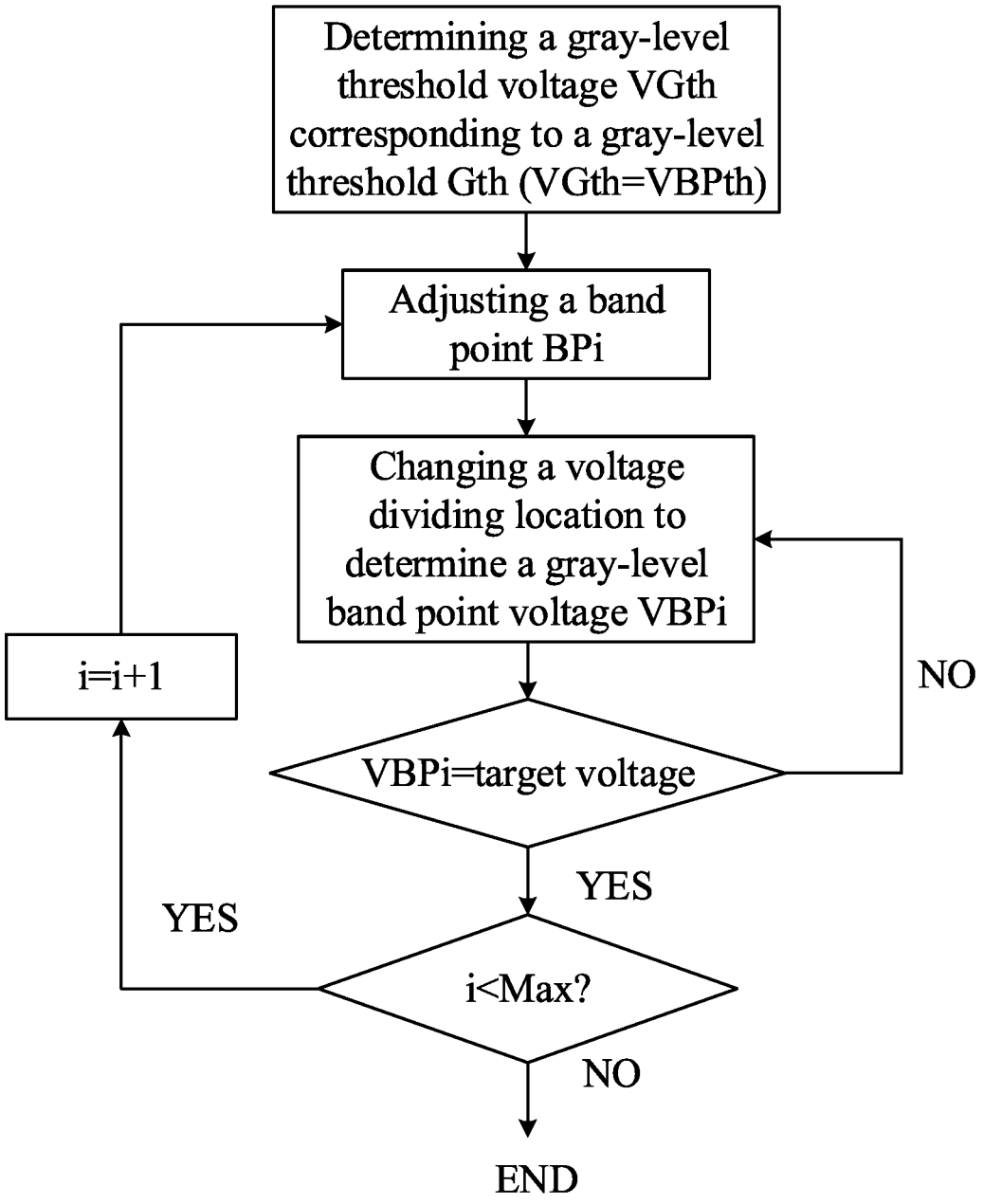
FIG. 9 is a flowchart of a voltage adjusting method according to an embodiment of the present invention.

FIG. 9 is a flowchart of a voltage adjusting method according to an embodiment of the present invention. In the present embodiment, a gray-level threshold voltage VGth corresponding to a gray-level threshold Gth (VGth=VBPth) is determined before a band point BPi is adjusted. After that, according to an order of band point labels from low to high, the band points BPi of the Gamma voltage divider circuit are sequentially selected to adjust the band points BPi. Next, a voltage dividing location is changed to determine a gray-level band point voltage VBPi of the band point. Then, whether the gray-level band point voltage VBPi is equal to a target voltage is determined. If yes, execute a next step. If no, the process returns back to changing the voltage dividing location to determine the gray-level band point voltage VBPi of the band point. Then, the process is to determine whether the band point label of a selected band point is smaller than the highest band point label, i.e., i<Max? If yes, terminate the adjustment of the band points. If no, renew the band point label, i.e., i=i+1. The process reselects a band point BPi to adjust the band point Bpi. The process makes sure that each band point is sequentially adjusted. In the end, the effect carried out by the curve shown in FIG. 6 is achieved.

Compared to the arrangement of voltage dividing resistor string of the existing Gamma voltage divider circuit, by changing the mapping of band point voltages, the voltage adjusting method of the present invention can optimize accuracy of low gray-level voltages in a further step, improve the display effect, and at the same time, reduce the number of voltage dividing resistors and lower the complexity and cost of the Gamma voltage divider circuit. The voltage adjusting method of the present invention is adaptable to the voltage dividing resistor string settings of OLED display panels and is also adaptable to the voltage dividing resistor string settings of LCD panels.

INDUSTRIAL UTILITY

The subject matter of the present application can be manufactured and used in industries and thus complies with industrial utility.

What is claimed is:

1. A Gamma voltage divider circuit, comprising:

at least two gray-level resistor strings connected in series, each of the gray-level resistor strings comprising a plurality of voltage dividing resistors for providing a plurality of gray-level band point voltages, each of the gray-level band point voltages corresponding to a band point; and at least a gray-level threshold voltage, inputted to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings, wherein the at least two gray-level resistor strings connected in series comprise:

a first gray-level resistor string comprising a plurality of first voltage dividing resistors, the first gray-level resistor string providing a plurality of first gray-level band point voltages, each of the first gray-level band point voltages corresponding to a first band point; and a second gray-level resistor string connected in series with the first gray-level resistor string, the second gray-level resistor string comprising a plurality of second voltage dividing resistors, the second gray-level resistor string providing a plurality of second gray-level band point voltages, each of the second gray-level band point voltages corresponding to a second band point, wherein the at least a gray-level threshold voltage comprises a first gray-level threshold voltage, inputted to a common terminal of the second gray-level resistor string and the first gray-level resistor string, and wherein the first gray-level threshold voltage is greater than all of the second gray-level band point voltages and is smaller than all of the first gray-level band point voltages.

2. The Gamma voltage divider circuit according to claim 1, wherein all of band points in the Gamma voltage divider circuit are divided into a plurality of first band points and a plurality of second band points based on a first gray-level threshold band point, and the plurality of first voltage dividing resistors corresponding to the plurality of first band points are adopted as the first gray-level resistor string and the plurality of second voltage dividing resistors corresponding to the plurality of second band points are adopted as the second gray-level resistor string, and wherein a gray-level voltage corresponding to the first gray-level threshold band point is the first gray-level threshold voltage.

3. The Gamma voltage divider circuit according to claim 1, wherein the at least two gray-level resistor strings connected in series comprise:

a third gray-level resistor string connected in series with the second gray-level resistor string, the third gray-level resistor string comprising a plurality of third voltage dividing resistors, the third gray-level resistor string providing a plurality of third gray-level band point voltages, each of the third gray-level band point voltages corresponding to a third band point;

wherein the at least a gray-level threshold voltage comprises a second gray-level threshold voltage, inputted to a common terminal of the second gray-level resistor string and the third gray-level resistor string, wherein the second gray-level threshold voltage is greater than all of the third gray-level band point voltages and is smaller than all of the second gray-level band point voltages.

4. The Gamma voltage divider circuit according to claim 3, wherein all of band points in the Gamma voltage divider circuit are divided into a plurality of first band points, a plurality of second band points, and a plurality of third band points based on a first gray-level threshold band point and a second gray-level threshold band point, and the plurality of first voltage dividing resistors corresponding to the plurality of first band points are adopted as the first gray-level resistor string, the plurality of second voltage dividing resistors corresponding to the plurality of second band points are adopted as the second gray-level resistor string, and the plurality of third voltage dividing resistors corresponding to the plurality of third band points are adopted as the third gray-level resistor string, and wherein a gray-level voltage corresponding to the first gray-level threshold band point is the first gray-level threshold voltage and a gray-level voltage corresponding to the second gray-level threshold band point is the second gray-level threshold voltage.

5. A liquid crystal display device, comprising a Gamma voltage divider circuit which comprises:

at least two gray-level resistor strings connected in series, each of the gray-level resistor strings comprising a plurality of voltage dividing resistors for providing a plurality of gray-level band point voltages, each of the gray-level band point voltages corresponding to a band point; and at least a gray-level threshold voltage, inputted to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings, wherein the at least two gray-level resistor strings connected in series comprise:

a first gray-level resistor string comprising a plurality of first voltage dividing resistors, the first gray-level resistor string providing a plurality of first gray-level band point voltages, each of the first gray-level band point voltages corresponding to a first band point; and a second gray-level resistor string connected in series with the first gray-level resistor string, the second gray-level resistor string comprising a plurality of second voltage dividing resistors, the second gray-level resistor string providing a plurality of second gray-level band point voltages, each of the second gray-level band point voltages corresponding to a second band point, wherein the at least a gray-level threshold voltage comprises a first gray-level threshold voltage, inputted to a common terminal of the second gray-level resistor string and the first gray-level resistor string, and wherein the first gray-level threshold voltage is greater than all of the second gray-level band point voltages and is smaller than all of the first gray-level band point voltages.

6. The liquid crystal display device according to claim 5, wherein all of band points in the Gamma voltage divider circuit are divided into a plurality of first band points and a plurality of second band points based on a first gray-level threshold band point, and the plurality of first voltage dividing resistors corresponding to the plurality of first band points are adopted as the first gray-level resistor string and the plurality of second voltage dividing resistors corresponding to the plurality of second band points are adopted as the second gray-level resistor string, and wherein a gray-level voltage corresponding to the first gray-level threshold band point is the first gray-level threshold voltage.

7. The liquid crystal display device according to claim 5, wherein wherein the at least two gray-level resistor strings connected in series comprise:

a third gray-level resistor string connected in series with the second gray-level resistor string, the third gray-level resistor string comprising a plurality of third voltage dividing resistors, the third gray-level resistor string providing a plurality of third gray-level band point voltages, each of the third gray-level band point voltages corresponding to a third band point;

wherein the at least a gray-level threshold voltage comprises a second gray-level threshold voltage, inputted to a common terminal of the second gray-level resistor string and the third gray-level resistor string, wherein the second gray-level threshold voltage is greater than all of the third gray-level band point voltages and is smaller than all of the second gray-level band point voltages.

8. The liquid crystal display device according to claim 7, wherein all of band points in the Gamma voltage divider circuit are divided into a plurality of first band points, a plurality of second band points, and a plurality of third band points based on a first gray-level threshold band point and a second gray-level threshold band point, and the plurality of first voltage dividing resistors corresponding to the plurality of first band points are adopted as the first gray-level resistor string, the plurality of second voltage dividing resistors corresponding to the plurality of second band points are adopted as the second gray-level resistor string, and the plurality of third voltage dividing resistors corresponding to the plurality of third band points are adopted as the third gray-level resistor string, and wherein a gray-level voltage corresponding to the first gray-level threshold band point is the first gray-level threshold voltage and a gray-level voltage corresponding to the second gray-level threshold band point is the second gray-level threshold voltage.

9. A voltage adjusting method, for adjusting a plurality of gray-level band point voltages provided by a Gamma voltage divider circuit of a liquid crystal display device, the method comprising:

(1) determining a gray-level threshold voltage corresponding to at least a gray-level threshold band point;

(2) based on all of the gray-level threshold band points, dividing the Gamma voltage divider circuit into a plurality of gray-level resistor strings connected in series, each of the gray-level resistor strings comprising a plurality of voltage dividing resistors for providing a plurality of gray-level band point voltages, each of the gray-level band point voltages corresponding to a band point;

(3) providing the gray-level threshold voltage to a common terminal of two adjacent gray-level resistor strings, wherein the gray-level threshold voltage is greater than all of the gray-level band point voltages of one of the two adjacent gray-level resistor strings and is smaller than all of the gray-level band point voltages of the other one of the two adjacent gray-level resistor strings; and (4) sequentially selecting band points of the Gamma voltage divider circuit, and adjusting the gray-level band point voltages of the selected band points until all of the band points of the Gamma voltage divider circuit are adjusted one by one, wherein:

Step (1) further comprises determining a first gray-level threshold voltage corresponding to a first gray-level threshold band point;

Step (2) further comprises dividing all of the band points in the Gamma voltage divider circuit into a plurality of first band points and a plurality of second band points based on the first gray-level threshold band point, adopting a plurality of first voltage dividing resistors corresponding to the plurality of first band points as a first gray-level resistor string, and adopting a plurality of second voltage dividing resistors corresponding to the plurality of second band points as a second gray-level resistor string; and Step (3) further comprises providing the first gray-level threshold voltage to a common terminal of the first gray-level resistor string and the second gray-level resistor string, wherein the first gray-level threshold voltage is greater than all of the gray-level band point voltages of the second gray-level resistor string and is smaller than all of the gray-level band point voltages of the first gray-level resistor string.

10. The method according to claim 9, wherein:

Step (1) further comprises determining a second gray-level threshold voltage corresponding to a second gray-level threshold band point;

Step (2) further comprises dividing all of the band points in the Gamma voltage divider circuit into the plurality of first band points, the plurality of second band points, and a plurality of third band points based on the first gray-level threshold band point and the second gray-level threshold band point, and adopting a plurality of third voltage dividing resistors corresponding to the plurality of third band points as a third gray-level resistor string; and Step (3) further comprises providing the second gray-level threshold voltage to a common terminal of the second gray-level resistor string and the third gray-level resistor string, wherein the second gray-level threshold voltage is greater than all of the third gray-level band point voltages and is smaller than all of the second gray-level band point voltages.

11. The method according to claim 9, wherein Step (4) further comprises:

(41) sequentially selecting the band points of the Gamma voltage divider circuit according to an order of band point labels from low to high;

(42) determining the gray-level band point voltage of a selected band point;

(43) determining whether the determined gray-level band point voltage is equal to a predetermined target voltage, and executing Step (44) if yes and changing a voltage dividing location and returning back to Step (42) if no; and (44) determining whether the band point label of the selected band point is smaller than a highest band point label, and terminating an adjustment of the band point if yes and updating the band point label and returning back to Step (41) if no.

* * * * *